United States Patent [19]

House, Jr.

[11] 4,027,742

[45] June 7, 1977

[54] CLEAT FOR CLIMBING TREES AND THE LIKE

[76] Inventor: Aniel Hermas House, Jr., 2204 S. Tyler, Little Rock, Ark. 72204

[22] Filed: Aug. 2, 1976

[21] Appl. No.: 710,641

[52] U.S. Cl. ..... 182/92

[51] Int. Cl.[2] ..... B60R 3/00

[58] Field of Search ..... 182/92, 189, 100, 150, 182/187

[56] References Cited

UNITED STATES PATENTS

| | | | |
|---|---|---|---|
| 1,559,842 | 11/1925 | Bollinger | 182/189 |
| 3,283,852 | 11/1966 | Merz | 182/92 |
| 3,598,201 | 8/1971 | Thurmond | 182/187 |

*Primary Examiner*—Reinaldo P. Machada
*Attorney, Agent, or Firm*—Huebner & Worrel

[57] ABSTRACT

An improved cleat for climbing trees and the like having a shank adapted to be supported in suspended relation from a chain passed around the trunk and connected to opposite ends of a transversely oriented cross bar rigidly affixed to the uppermost end of the shank. A step projects horizontally from the lower most end of the shank and is stabilized through combined stabilizing effects of a downwardly projected heel and the cross bar.

3 Claims, 3 Drawing Figures

CLEAT FOR CLIMBING TREES AND THE LIKE

BACKGROUND OF THE INVENTION

1. Field of the Invention

The invention generally relates to climbing cleats and more particularly to an improved cleat for climbing trees and the like without inflicting penetration damage.

2. Description of the Prior Art

The prior art includes numerous climbing devices for use in scaling wooden poles, trees, and the like. Often the devices previously employed include sharpened cleats adapted to be strapped to a climbers legs so that the cleats can be forced to penetrate and thus acquire a purchase on the tree or pole as the cleats are thus embedded. Generally, such cleats perform quite satisfactorily for climbing purposes. Unfortunately, as can readily be appreciated, due to the required penetration such cleats tend to inflict damage, particularly to the trees, when employed in the intended manner. The extent of the damage thus inflicted has become of such concern that a use of cleats which penetrate the bark of trees often is totally prohibited by various Governmental Agencies.

Such prohibition has greatly impaired the pursuit of various activities, including the hunting of wild game in the forests, since, frequently, hunters find the scaling of trees to be a particularly useful technique in locating game. Presently, use of ladders and the like is resorted to in order to comply with the prohibition. The inadequacy of ladders, when used by hunters', should abundantly be clear in view of the inherent bulk, weight and economic factors.

It should, therefore, readily be apparent that there currently exists a need for a practical cleat which is portable, compact, economic to manufacture and one which can readily be used without inflicting damages to the tree and the like as they are climbed.

It is therefore a general purpose of the present invention to provide an improved cleat for use in climbing trees and the like which overcome the aforementioned difficulties and disadvantages previously encountered when using currently available cleats and similar devices.

OBJECT AND SUMMARY OF THE INVENTION

It is therefore the object of the invention to provide an improved climbing cleat for use in climbing trees and the like.

It is another object to provide an improved climbing cleat particularly suited for use in climbing trees and the like without inflicting thereon damage resulting from puncture.

It is another object to provide a light weight, economic cleat which is particularly suited for use in climbing objects such as trees, poles and the like.

Another advantage is to provide an improved economic and portable climbing cleat which is particularly useful in connection with the climbing of trees, by hunters and the like, without puncturing the bark thereof, although not necessarily restricted in use thereto, since the cleat may be employed equally as well in climbing wooden poles of a general classification for repair and other purposes.

These together with other objects and advantages will become more readily apparent by reference to the following description and claims in light of the accompanying drawings.

DESCRIPTION OF THE PREFERRED EMBODIMENT

Figure 1:
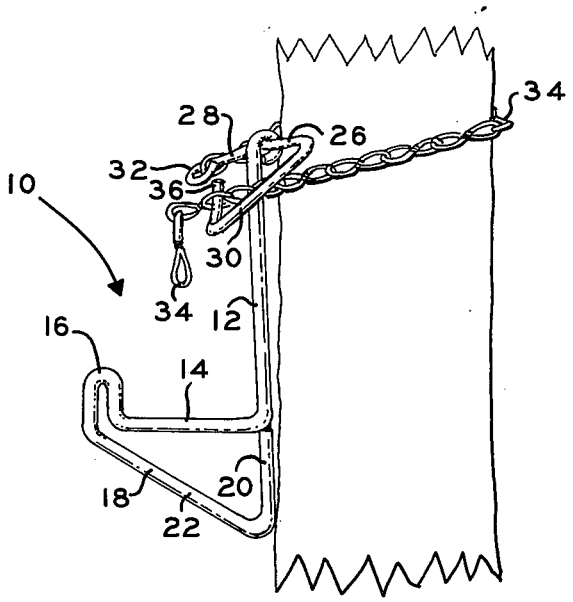
FIG. 1 is a side elevational view of an improved climbing cleat, which embodies the principles of the present invention, suspended in an operational configuration.
Figure 2:
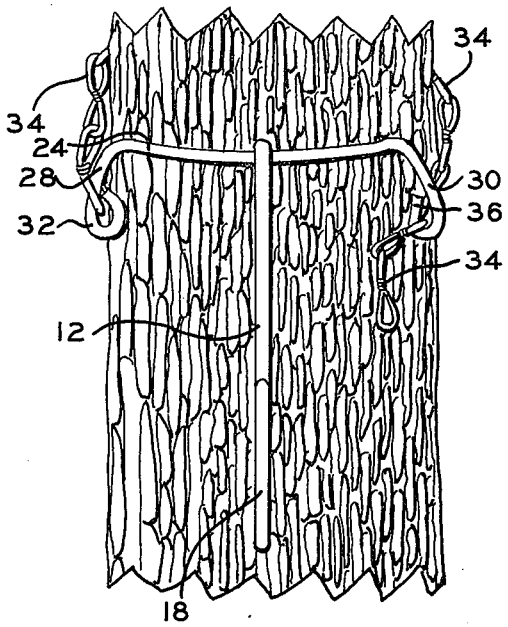
FIG. 2 is a front elevational view of the cleat as it is suspended from a trunk of a tree.
Figure 4:
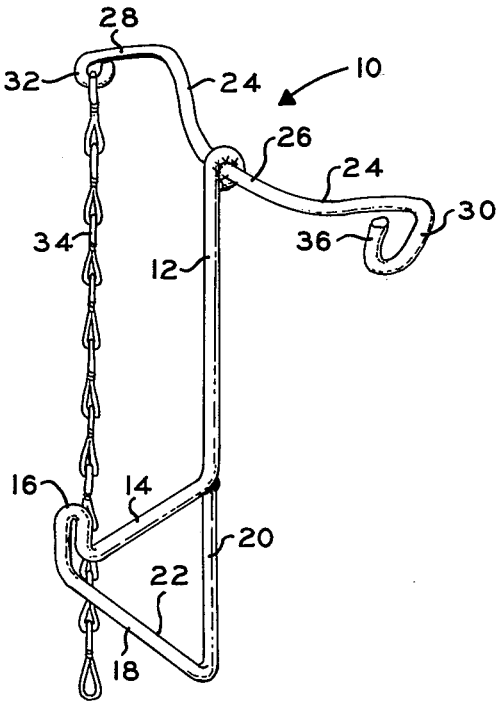
FIG. 4 is a perspective view of the cleat.
Figure 3:
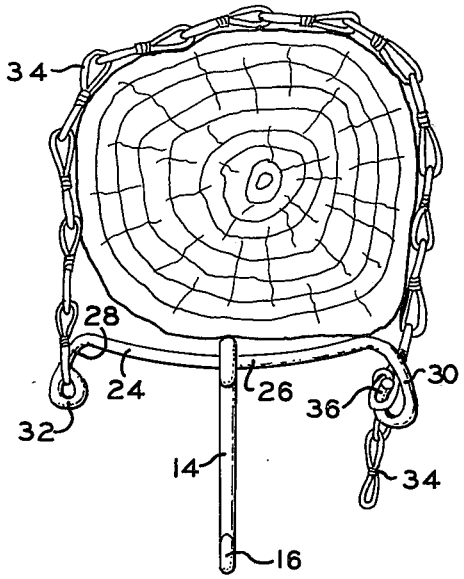
FIG. 3 a pictorial view top plan view of the cleat.

Referring now to the drawings, with more particularity, wherein like references characters designate like or corresponding parts thereof in several views, there is shown in FIG. 1 an improved cleat, generally designated 10, which embodies the principles of the present invention.

The cleat 10, as shown, includes an elongated shank 12 having an angularly projected step 14 terminating in a protuberance forming stop designated 16. As a practical matter, the length of a step is a length sufficient to receive the sole of climber's shoe while the stop 16 is of a height sufficient to prevent the shoe from slipping laterally off the end of the step 14.

Connected to the distal or outer most end of the step 14 is an angular support bracket 18 which serves as a stabilizing heel for the cleat 10. This bracket also lends vertical support to the step 14 and includes a base portion 20, extended in coaxial relation with the shank 12 from which projects an inclined support member 22. This member preferably extends from the lowermost portion 20 to the stop 16.

As shown in the drawings, the cleat 10 is formed from 5/16 inch mild steel rod and is of a welded integral construction. However, it is to be understood that the cleat 10 can be formed from any suitable material utilizing any of various suitable fabricating techniques.

Extended transversely across the end of the shank 12, in spaced relation with the step 14, there is a rigid cross bar 24. This bar includes a mid portion 26 of a substantially arcuate configuration and a pair of end portions 28 and 30, angularly related to the mid portion.

The arcuate configuration of the mid portion 26 of the cross bar 24 is such that nesting of the cross bar against the curved surface of a tree or pole is facilitated while the end portions 28 and 30 thereof project outwardly in mutual parallelism preferably along opposite sides of a common plane of symmetry for the cleat. Moreover, it is important to note that the end portions 28 and 30 are also inclined toward the plane of the step 14 for reasons which will hereinafter become more readily apparent.

The end portion 28 of the cross bar 24 is provided with a terminal eye 32 within which there is received one end of a chain 34. This chain is adapted to be placed in circumscribing relation with the trunk of the tree to which the cleat is to be attached. The opposite end of the cross bar, designated 30, includes a terminal hook 36 for receiving an opening of a link of the chain 34, after it has been passed about the trunk for purposes of taking a purchase. Thus, the cleat 10 is adapted to be suspended from the surface of a trunk of a tree, pole or similar body.

As aforementioned, it is important to note that the end portions 28 and 30 of the cross arm 34 extend downwardly as well as outwardly from a trunk of a tree. This permits a moment to be developed about an axis passing horizontally through the uppermost end of the shank 12 as the weight of a climber is applied to the step 14. Thus, the bracket 18 which serves as a heel for the cleat is forced inwardly into frictional engagement with the adjacent surface of the tree for thereby increasing the magnitude of friction developed between the adjacent surfaces of the cleat and tree from which the cleat is suspended. Hence, it should be apparent that the heel co-operates with the cross bar 24 for purposes of imparting stability to the cleat 10. That stability of the cleat 10, as it is employed, is particularly desirable, can be appreciated when it is recognized that the cleat is used by attaching a series of cleats in mutually spaced relation to the trunk of the tree being climbed.

OPERATION

When employing the cleat 10, for purposes of climbing trees, and similar bodies, the cleat is first placed in a vertical orientation against the surface of the body and the chain 34 then passed around the body in circumscribing relation therewith. The extended end of the chain is secured to the hook 36 by inserting the hook through an opening in a selected link of the chain.

A climber now steps upon the step 14 so that his weight is suspended thereby. Due to the angular position of the end portions 28 and 30 of the cross bar 24, a moment is developed about a horizontal axis extending through the uppermost end of the shank 12 so an inwardly directed component of force is developed in the bracket 18 forcing the base portion 20 thereof against the surface of the tree for thus stabilizing the cleat. Due to the stabilizing effect of the heel portion 20, combined with the stabilizing effect of the cross bar 24, the cleat remains in a substantially fixed relationship with the surface of the body being climbed.

The climber now attaches, in a similar fashion, a second cleat to the surface of the body being climbed. This cleat is then stepped upon in the same manner as the previous cleat, with substantially the same effect, and so on.

It should, in view of the foregoing, be apparent that the cleat 10 is employed as a practical solution to the perplexing problem of climbing trees, poles and similar bodies without inflicting serious damage through penetration of the surface thereof.

Although the invention has been shown and described in what is conceived to be the most practical and preferred method and apparatus, it is recognized that departures may be made therefrom within the scope of the invention, which is not to be limited to the illustrative details disclosed.

Having described my invention, what I claim as new and desire to secure by Letters Patent is:

1. An improved climbing cleat comprising:

A. an elongated shank;

B. means defining a step angularly projected from the shank near one end thereof;

C. suspension means for removably suspending said shank from a vertically oriented body of a substantially cylindrical configuration including a cross bar extended transversely with respect to said shank and rigidly affixed to the end portion thereof opposite said one end having an arcuate midportion and a pair of end portions extended in substantial parallelism and inclined toward said step, a length of chain, and means located at each of the opposite ends of said cross bar for receiving said chain in a connected relationship therewith; and D. stabilizing means for supporting said step against displacement including a support member extended angularly from the projected end of said step toward an extension of the longitudinal axis of said shank for imparting vertical support to the step.

2. The cleat of claim 1 wherein said chain is adapted to be passed about the trunk of a tree, the midportion of said cross bar is adapted to receive the trunk of said tree, in a nested relationship and said heel portion is adapted to rest against the trunk of the tree.

3. The cleat of claim 2 wherein a downward force applied to said step results in a tightening the purchase of said chain about said trunk of the tree.

* * * * *